United States Patent [19]

Illgner

[11] 4,177,531

[45] Dec. 11, 1979

[54] DEVICE FOR ADJUSTING AND COUPLING AMPHIBIOUS VEHICLES

[75] Inventor: Eberhard Illgner, Nieder-Olm, Fed. Rep. of Germany

[73] Assignee: Magirus-Deutz AG, Ulm, Fed. Rep. of Germany

[21] Appl. No.: 945,201

[22] Filed: Sep. 20, 1978

[51] Int. Cl.[2] ..... E01D 21/00

[52] U.S. Cl. ..... 14/27; 114/249; 213/75 R

[58] Field of Search ..... 14/2.4, 27, 28, 16.1; 405/219, 204; 114/249; 213/75 R, 78, 153, 19

[56] References Cited

U.S. PATENT DOCUMENTS

| | | | |
|---|---|---|---|
| 2,157,959 | 5/1939 | Knight | 14/27 |
| 2,754,978 | 7/1956 | Metzger | 213/20 |
| 2,825,077 | 3/1958 | Sedlacek | 14/27 |
| 2,825,473 | 3/1958 | Metzger | 213/153 X |
| 2,993,459 | 7/1961 | Storey | 14/27 X |
| 3,021,544 | 2/1962 | Gillois | 14/27 |
| 3,036,539 | 5/1962 | Storey | 14/27 X |
| 3,066,332 | 12/1962 | Sedlacek | 14/27 X |
| 3,430,601 | 3/1969 | Thompson | 114/249 X |
| 3,504,389 | 4/1970 | Longbottom | 14/27 X |
| 3,756,183 | 9/1973 | Clemence | 114/249 |

*Primary Examiner*—Nile C. Byers, Jr.
*Attorney, Agent, or Firm*—Becker & Becker, Inc.

[57] ABSTRACT

A device for adjusting adjacent differently immersed amphibious vehicle or floating bodies to a common coupling level, in which the oppositely located end or side walls of the vehicle or floating bodies to be interconnected are provided with supporting arms and abutment surfaces while the supporting arms arranged on the respective higher located vehicle or floating body are pivoted below abutment surfaces of the respective lower located vehicle or floating body which in response to a further movement of the pivotable supporting arms are automatically lifted into the common coupling level.

7 Claims, 3 Drawing Figures

DEVICE FOR ADJUSTING AND COUPLING AMPHIBIOUS VEHICLES

The present invention relates to a device for adjusting amphibious vehicles with regard to a common coupling level which vehicles are deeply immersed and arranged adjacent to each other in water, for forming a floating bridge.

It frequently occurs that when building a bridge, the floating or vehicle bodies of amphibious vehicles which bodies are to be connected to each other, are deeply and to a different extent immersed in the water. In order to equalize or adjust the difference in the level, usually time-consuming and complicated maneuvering operations of the personnel are required which considerably delay the building of the amphibious bridge.

It is, therefore, an object of the present invention so to improve the devices associated with the amphibious vehicles for coupling that the above drawbacks will be overcome.

These and other objects and advantages of the invention will appear more clearly from the following specification in connection with the accompanying drawings, in which.

Figure 1:
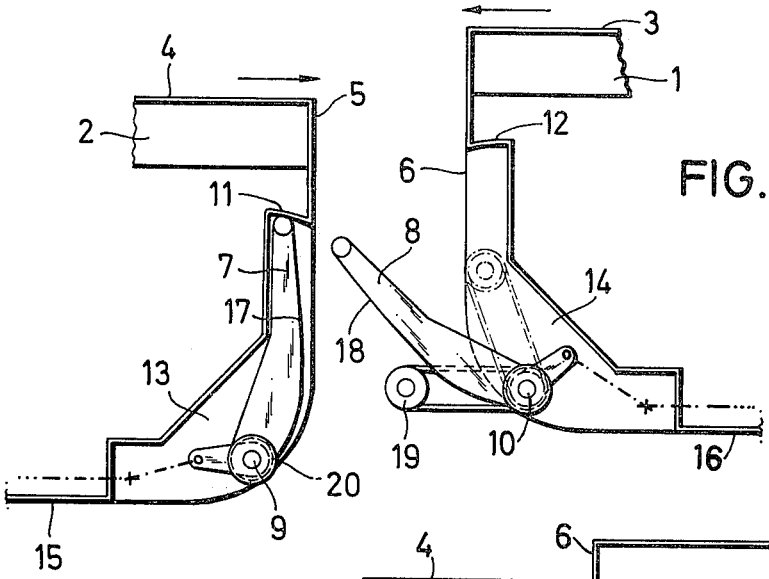
FIG. 1 represents a diagrammatical side view of the two adjacent floating bodies having the end faces thereof provided with devices according to the present invention.

The device according to the present invention is characterized primarily in that those end faces or side walls which face each other and pertain to the vehicle and floating bodies to be interconnected are provided with supporting arms and abutment surfaces while the respective supporting arms arranged on the vehicle or floating bodies located at a higher level are pivoted below the abutment surfaces of the vehicle or floating bodies at a lower level, which last mentioned vehicles or floating bodies are when bringing the vehicles closer together automatically lifted by the pivot arms onto the common coupling height or level.

This arrangement has the advantage that differences in the level for instance of 250 mm, between the vehicles to be interconnected can be equalized without difficulty. In this connection, the equalization of the differences in level is after pivoting the supporting arms, effected completely automatically. Furthermore, a centering of the individual vehicles is realized so that not only differences in level but also slight displacements in length between the vehicles to be interconnected will be equalized.

According to a further development of the invention, it is provided that the supporting arms are pivotable about vertical axes and funnel-shaped recesses of the end face or side walls. In this connection, it is advantageous that the upper confinement of the recesses simultaneously forms the abutment surfaces. For centering the vehicles in the longitudinal direction, the abutment surfaces are arched about a longitudinal transverse axis of the respective vehicle. It is furthermore expedient to pivot the supporting arms within the recesses into a vertical position while the outwardly located sides thereof during the equalization of difference in level serve as guiding paths for the abutting supporting arms.

For purposes of simplifying the device, it is also advantageous when the supporting arms together with the coupling elements interconnecting the vehicles are mounted on the same pivot axles.

Referring now to the drawing in detail, as will be seen therefrom, two floating bodies 1 and 2 are pivotally mounted on non-illustrated vehicle bodies of amphibious bridge vehicles for pivoting laterally about longitudinal axes of said vehicles. For purposes of building the amphibious bridge, the adjacent floating bodies 1 and 2 are to be coupled to each other. However, before the coupling can be effected, it is necessary that the floating bodies 1 and 2 which in most instances are offset in longitudinal and vertical direction of the vehicles be adjusted to a common coupling level. By "coupling level" is understood that the position of the floating bodies 1 and 2 in which on one hand a proper and safe connection of the two floating bodies is possible, and on the other hand the upper deck sides 3 and 4 are located on a common horizontal plane so that after effective coupling, all amphibious vehicles form a floating bridge while the individual deck sides of the floating bodies form a continuous deck surface.

To this end, for coupling purposes, those end faces 5 and 6 of the floating bodies 1 and 2 which are located opposite to each other, are at locally the same place provided with supporting arms 7 and 8 respectively which supporting arms are pivotable about longitudinal axles 9 and 10 respectively. Furthermore, each end face 5, 6 is provided with an abutment surface 11, 12 respectively below which one of the two supporting arms 7 or 8 can be pivoted.

In order to avoid projecting parts at the end faces 5 and 6, the supporting arms 7, 8 are respectively arranged in recesses 13, 14 of the floating bodies 1 and 2 respectively. These recesses 13, 14 are so designed that their upper confinement simultaneously forms the abutment surfaces 11 and 12. The pivot axles 9 and 10 are located within the region of the bottom sides 15 and 16 respectively of the floating bodies. As a result thereof, as long as possible supporting arms may be employed which in pivoted-in condition are located vertically in said recesses. This has the advantage that their outwardly located sides 17 and 18 respectively serve as guiding paths for the abutting supporting arms. The pivoting of the supporting arms 7 and 8 may be effected by any known suitable pivot drives.

Figure 2:
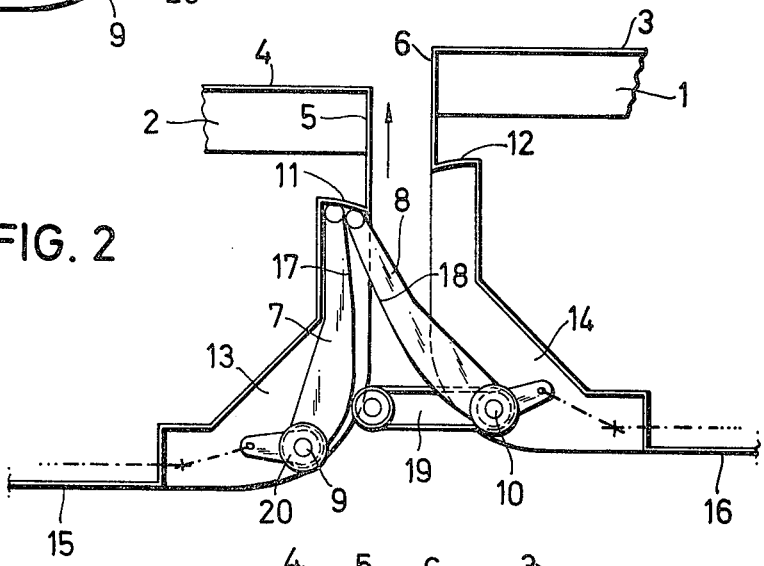
FIG. 2 shows the devices of FIG. 1 closer together and in a position for lifting the floating body which is located lower than the other floating body to be connected thereto.

More specifically, according to FIG. 1, the floating body 2 is immersed in water to a greater extent than the floating body 1. For purposes of lifting the floating body 2 to a common coupling level, the supporting arm 8 of the floating body 2 is pivoted outwardly in coupling direction. The supporting arm 7 on the floating body 2 remains in its inwardly pivoted position within the recess 13. When moving the floating bodies 1 and 2 closer to each other as shown in FIG. 2, the head end of the supporting arm 8 first contacts the side 17 of the supporting arm 7 and on the latter movew upwardly until it abuts the abutment surface 11. By means of the abutment surface arched in the longitudinal or transverse direction of the vehicle, both floating bodies are first centered with regard to each other. While the two floating bodies move further toward each other, the pivot arm 8 is pivoted in the direction toward the floating body 1 which floating body 1 lifts the floating body 2 automatically onto the common coupling level. Inversely, if the floating body 2 has immersed to a greater extent than the floating body 1, the floating body 2 is lifted by the pivot arm 7 on the floating body 1 onto the common coupling level.

Figure 3:
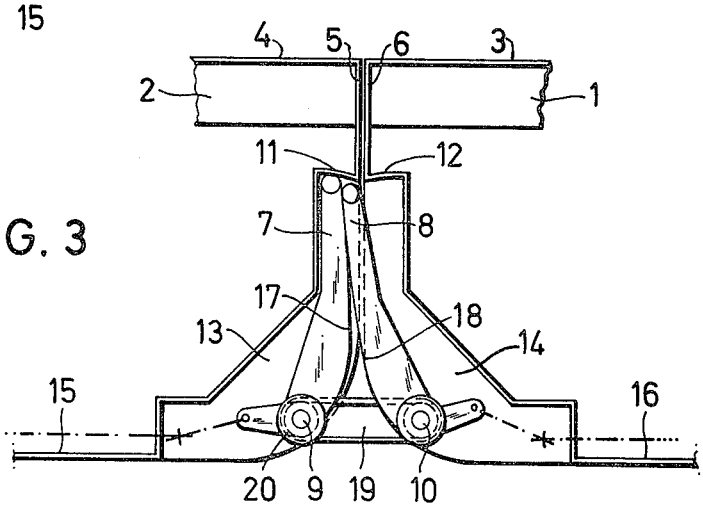
FIG. 3 shows the floating bodies of FIGS. 1 and 2 in their adjusted and coupled end position.

FIG. 3 shows the floating bodies 1 and 2 in adjusted or equalized end position. Both floating bodies 1 and 2 are interconnected by coupling elements which likewise are arranged within the region of the end faces 5 and 6. The coupling elements primarily consist of a coupling latch 19 which is pivotally mounted on the floating body 1, said latch 19 extending around a coupling bolt 20 provided on the floating body 2. Coupling latch 19 as well as coupling bolts 20 are journalled on the axles 9 and 10 of the supporting arms 7 and 8 respectively.

Within the scope of the invention, the supporting arms and abutment surfaces are in addition to being provided on the floating bodies, also arranged in the side walls of the vehicle bodies of all amphibious bridge vehicles. Such an arrangement makes an adjustment of the equalization bodies between adjacent vehicles as well as between vehicles and floating bodies.

It is, of course, to be understood that the present invention is, by no means, limited to the specific showing in the drawing, but also comprises any modifications within the scope of the appended claims.

What is claimed is:

1. An arrangement for adjusting adjacent differently immersed amphibious floating bodies to a common coupling height, which includes: a first amphibious floating body, a second amphibious floating body, each of said floating bodies having at least one wall thereof provided with a supporting arm pivotally connected thereto, and also having an abutment surface adapted to receive therebelow the supporting arm of the pertaining floating body and also the supporting arm of the other floating body to be connected thereto, each supporting arm pertaining to the respective less immersed floating body being adapted to be pivoted below the abutment of the respective deeper immersed floating body and to be locked therebelow to thereby lift said deeper immersed floating bodies so as to align the surfaces of said floating bodies while interconnecting said last mentioned floationg bodies.

2. An arrangement according to claim 1, in which those end faces of said floating bodies which face each other and are to be connected to each other respectively comprise a recess adapted to receive the respective pertaining supporting arm and a portion of the respective cooperating supporting arm, each of said supporting arms being pivotable about a horizontal axle respectively supported by the respective floating bodies to be interconnected.

3. An arrangement according to claim 2, in which the upper confining wall of each recess forms the pertaining abutment surface of the pertaining floating body.

4. An arrangement according to claim 1, in which each of said abutment surfaces is arched about a transverse axis of the pertaining floating body.

5. An arrangement according to claim 1, in which each of said abutment surfaces is arched about the longitudinal axis of the pertaining floating body.

6. An arrangement according to claim 2, in which each supporting arm is pivotable into an about vertical position in its pertaining recess, and in which that side of said supporting arms which faces the respective cooperating supporting arm serves as guiding path for said last mentioned supporting arm.

7. An arrangement according to claim 1, in which said floating bodies include pivotable coupling means for coupling said floating bodies together, and in which the supporting arm and the coupling means pertaining to one and the same wall portion of each floating body are pivotable about a common axle.

* * * * *